United States Patent [19]

Hall et al.

[11] 4,354,848

[45] Oct. 19, 1982

[54] OUTBOARD MOTOR WITH TILT LINKAGE INCLUDING PIVOT LINK

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 173,159

[22] Filed: Jul. 28, 1980

[51] Int. Cl.[3] ..... B63H 21/26

[52] U.S. Cl. ..... 440/61; 248/642

[58] Field of Search ..... 440/61, 63, 55, 56, 440/59; 248/640–643

[56] References Cited

U.S. PATENT DOCUMENTS

| | | | |
|---|---|---|---|
| 3,722,455 | 3/1973 | Carpenter | 440/61 |
| 3,847,108 | 11/1974 | Shimanckes | 74/378 X |
| 3,863,592 | 2/1975 | Borst | 188/317 X |
| 3,885,517 | 5/1975 | Borst et al. | 440/61 |
| 3,983,835 | 10/1976 | Hall | 440/61 |
| 4,013,249 | 3/1977 | Meyer et al. | 440/55 X |
| 4,064,824 | 12/1977 | Hall et al. | 440/61 |
| 4,096,820 | 1/1978 | Hall et al. | 440/61 |
| 4,177,747 | 12/1979 | Pichl | 440/52 |

*Primary Examiner*—Sherman D. Basinger

*Attorney, Agent, or Firm*—Michael, Best & Friedrich

[57] ABSTRACT

Disclosed herein is an outboard motor comprising a transom bracket adapted to be fixedly mounted to a boat transom, an intermediate bracket, a pivot connecting the intermediate bracket to the transom bracket for pivotal movement of the intermediate bracket in a vertical plane about a first axis which is horizontal when the transom bracket is boat mounted, a propulsion unit including a propeller, a king pin connecting the propulsion unit to the intermediate bracket for pivotal sterring movement of the propulsion unit in a horizontal plane relative to the intermediate bracket, a pivot link, a pivot connecting the pivot link to the transom bracket for pivotal movement about a second axis parallel to the first axis, an extensible link having opposite ends, a pivot connecting one of the opposite ends of the extensible link to the pivot link about a third axis parallel to the first axis, a pivot connecting the other of the opposite ends of the extensible link to the intermediate bracket about a fourth axis parallel to the first axis, and a link operable, in response to extension of the extensible link, for pivoting the pivot link so as to additionally increase the distance from the second axis to the fourth axis.

14 Claims, 4 Drawing Figures

OUTBOARD MOTOR WITH TILT LINKAGE INCLUDING PIVOT LINK

RELATED APPLICATIONS

Reference is hereby made to the following related applications, all of which are assigned to the assignee of this application and all of which are incorporated herein by reference:

Stevens application Ser. No. 159,480, filed June 16, 1980, and entitled OUTBOARD MOTOR WITH ELEVATED HORIZONTAL PIVOT AXIS.

Blanchard application Ser. No. 167,337, filed July 9, 1980, and entitled OUTBOARD MOTOR WITH DUEL TRIM AND TILT AXES.

Hall et al application Ser. No. 173,158, filed July 28, 1980, and entitled MARINE PROPULSION DEVICE STEERING MECHANISM.

Hall et al application Ser. No. 183,209, filed Sept. 2, 1980, and entitled HYDRAULIC SYSTEM FOR OUTBOARD MOTOR WITH SEQUENTIALLY OPERATING TILT AND TRIM MEANS.

Hall et al application Ser. No. 173,160, filed July 28, 1980, and entitled OUTBOARD MOTOR WITH SEQUENTIALLY OPERATING TILT AND TRIM MEANS.

Hall et al application Ser. No. 173,162, filed July 28, 1980, and entitled LATERAL SUPPORT ARRANGEMENT FOR OUTBOARD MOTOR WITH SEPARATE TILT AND TRIM AXIS.

BACKGROUND OF THE INVENTION

The invention relates to marine propulsion devices and, more particularly, to outboard motors including propulsion units which are steerable in a horizontal plane and tiltable in a vertical plane.

The invention also relates to arrangements for power tilting of propulsion units between a lower normal running position in which the propeller is submerged in water, and a tilted or raised position in which the propeller is located for above-the-water-accessability.

Various arrangements for power tilting of marine propulsion units are set forth in the following U.S. Pat. Nos: Carpenter—3,722,455 Mar. 27, 1973; Shimanckas—3,847,108 Nov. 12, 1974; Borst—3,863,592 Feb. 4, 1975; Borst—3,885,517 May 27, 1975; Hall—3,983,835 Oct. 5, 1976; Hall—4,064,824 Dec. 27, 1977; Hall—4,096,820 June 27, 1978; Pichl—4,177,747 Dec. 11, 1979.

SUMMARY OF THE INVENTION

The invention provides an outboard motor comprising transom bracket means adapted to be fixedly mounted to a boat transom, second bracket means, means connecting the second bracket means to the transom bracket means for pivotal movement of the second bracket means in a vertical plane about a first axis which is horizontal when the transom bracket means is boat mounted, a propulsion unit including a propeller, means connecting the propulsion unit to the second bracket means for pivotal steering movement of the propulsion unit in a horizontal plane relative to the second bracket means, a pivot link, means pivotally connecting the pivot link to the transom bracket means for pivotal movement about a second axis parallel to the first axis, an extensible link having opposite ends, means pivotally connecting one of the opposite ends of the extensible link to the pivot link about a third axis parallel to the first axis, means pivotally connecting the other of the opposite ends of the extensible link to the second bracket means about a fourth axis parallel to the first axis, and means operable, in response to extension of the extensible link, for pivoting the pivot link so as to additionally increase the distance from the second axis to the fourth axis.

In one embodiment in accordance with the invention, the means for additionally increasing the distance from the second axis to the fourth axis in response to extension of the extensible link comprises a follower link having opposed ends, means pivotally connecting one of the opposed ends of the follower link to the pivot link about a fifth axis parallel to the first axis, and means pivotally connecting the other of the opposed ends of the follower link to the second bracket means about a sixth axis parallel to the first axis.

In one embodiment in accordance with the invention, the pivot and follower links are rigid links.

In one embodiment in accordance with the invention, the second bracket means comprises a swivel bracket connected to the transom bracket means about the first axis and the means connecting the propulsion unit to the second bracket means comprises means including a king pin for pivotally connecting the propulsion unit to the swivel bracket for steering movement of the propulsion unit relative to the swivel bracket in a horizontal plane about a vertical axis.

In one embodiment in accordance with the invention, the second bracket means comprises a stern bracket connected to the transom bracket means about the first axis and wherein the means connecting the propulsion unit to the second bracket means includes a swivel bracket connected to the stern bracket for vertical tilting movement about a seventh axis parallel to the first axis, means for adjustably pivotally displacing the swivel bracket relative to the stern bracket about the seventh axis, and means including a king pin for pivotally connecting the propulsion unit to the swivel bracket for steering movement of the propulsion unit relative to the swivel bracket in a horizontal plane about a vertical axis.

In one embodiment in accordance with the invention, the second, third and fifth axes form a triangular pattern in a vertical plane.

In one embodiment in accordance with the invention the second bracket means is pivotally moveable about the first axis between a normal running position in which the propeller is submerged in water and a raised position in which the propeller is accessable above the water, and the extensible link is disposed principally vertically when the second bracket means is in the running position and is disposed principally horizontally when the second bracket means is in the raised position.

In one embodiment of the invention, the extensible link expands during movement of the second bracket means from the running position to the raised position, and the pivot link and the second bracket means pivot in the same rotational direction during pivotal movement of the second bracket means.

In one embodiment of the invention, the extensible link has an axis and a movement arm from the extensible link axis to the first axis which increases as the second bracket means travels from the running position to the raised position.

In one embodiment of the invention, the extensible link comprises a hydraulic cylinder-piston assembly.

In one embodiment in accordance with the invention, the distance between the second and the fourth axes is greater when the second bracket means is in the raised position than when the second bracket means is in the running position.

In one embodiment in accordance with the invention, upward tilting movement of the propulsion unit relative to the transom bracket means, in response to extension of the extensible link, serves to cause the follower link to rotate the pivot link in the direction to increase the distance between the second and fourth axes.

Other features and advantages of the embodiments of the invention will become known by reference to the following general description, claims and appended drawings.

IN THE DRAWINGS

Figure 2:
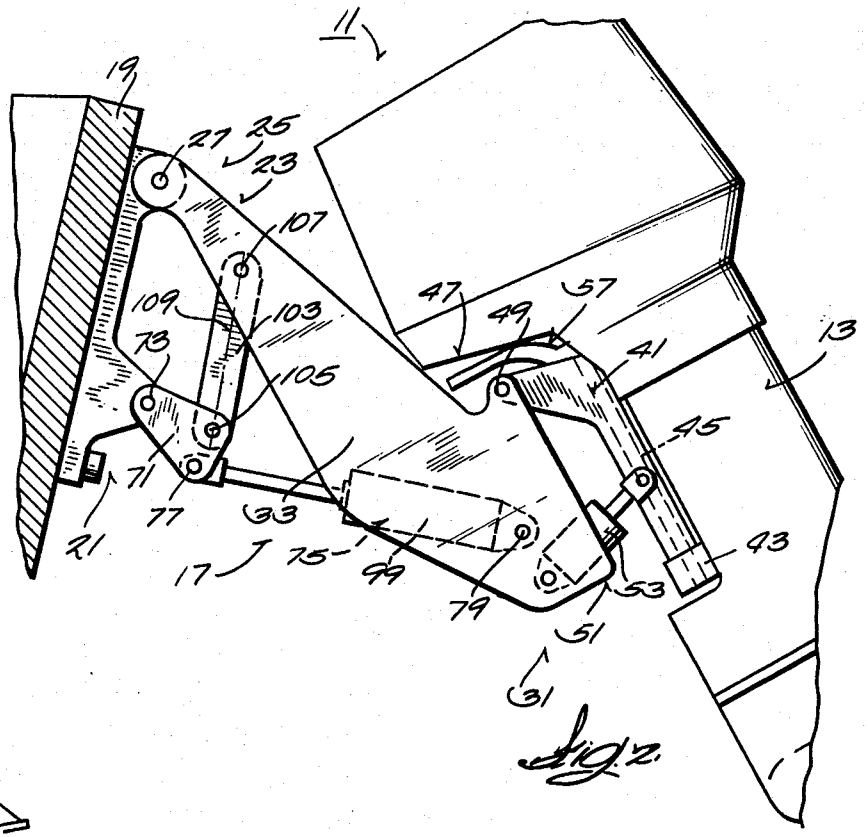
FIG. 2 is a fragmentary view similar to FIG. 1 illustrating the outboard motor in a partially raised or tilt position.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
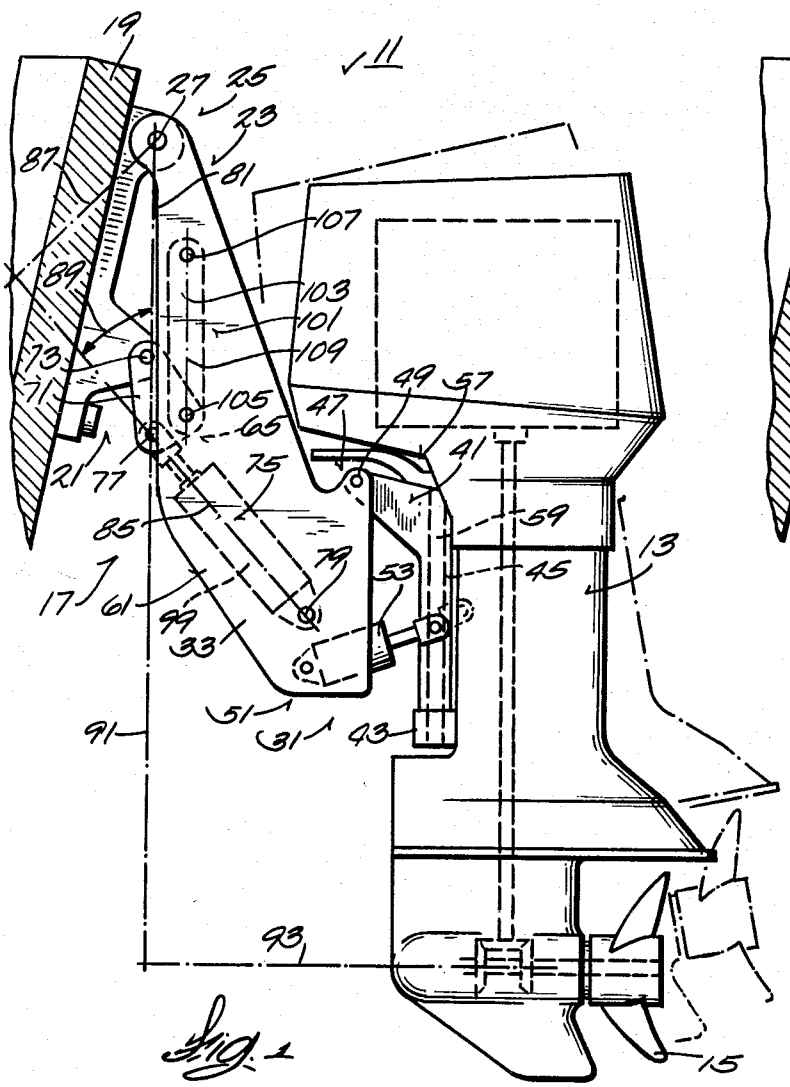
FIG. 1 is a fragmentary side elevational view of an outboard motor which embodies various of the features of the invention, and which is shown in the normal running position.

Shown in FIGS. 1 and 2 of the drawings is a marine propulsion device in the form of an outboard motor 11 including a propulsion unit 13 including a propeller 15, and means 17 for pivotally mounting the propulsion unit 13 to a boat transom 19 for pivotal steering movement of the propulsion unit 13 in a horizontal plane and for vertical tilting movement of the propulsion unit 13 in a vertical plane between a normal operating or running position with the propeller 15 submerged in water and a raised position providing above-the-water-accessibility to the propeller 15.

The means 17 for pivotally mounting the propulsion unit 13 can take various forms and, in the construction shown in FIGS. 1 and 2, such means comprises transom bracket means 21 adapted to be fixedly mounted to the rear of the boat transom 19. The transom bracket means 21 can be a unitary member or can comprise independent members each adapted for fixed connection to the boat transom 19.

The means 17 for pivotally mounting the propulsion unit 13 also includes second or intermediate bracket means 23, together with means 25 located rearwardly of the transom 19 for pivotally connecting the second bracket means 23 to the transom bracket means 21 for pivotal movement of the second bracket means 23 about a first or upper tilt axis 27 which is horizontal when the transom bracket means 21 is boat mounted. Any suitable means can be provided.

The means 17 for pivotally mounting the propulsion unit 13 also includes means 31 for pivotally connecting the propulsion unit 13 to the second bracket means 23 for tilting movement in common with the second bracket means 23 and for steering movement in a horizontal plane relative to the second bracket means 23. While various arrangements can be employed, in the construction shown in FIGS. 1 and 2, the second bracket means 23 comprises a stern or intermediate bracket 33 which, in the normal running position, engages the boat transom 19 for delivering propulsive thrust to the boat. The means 31 for pivotally mounting the propulsion unit 13 to the second bracket means 23 comprises a swivel bracket 41 including a vertical leg 43 having therein a bore 45, together with means 47 for pivotally connecting the swivel bracket 41 to the stern bracket 33 for pivotal movement in a vertical plane of the swivel bracket 41 relative to the stern bracket 33 about a lower trim axis 49 parallel to the upper tilt axis 27. Any suitable means can be employed.

The means 31 for pivotally connecting the propulsion unit 13 to the second bracket means 23 further includes means 51 for adjustably displacing the swivel bracket 41 relative to the stern bracket 33 comprising a suitable extensible member 53 such as, for instance, a hydraulic cylinder piston assembly, which at one end, is pivotally connected, by any suitable means, to the stern bracket 33 and which, at the other end, is pivotally connected, by any suitable means, to the swivel bracket 41.

The means 31 for pivotally mounting the propulsion unit to the second bracket means 23 further includes means 57 for pivotally connecting the propulsion unit 13 to the swivel bracket 41 for steering movement in a horizontal plane. While various arrangements can be employed, in the disclosed construction, a king pin 59 is fixed to the propulsion unit 13 and extends in the bore 45 in the vertical leg 43 in the swivel bracket 41, as in conventional construction.

Any suitable means can be employed for effecting steering movement of the propulsion unit 13 relative to the swivel bracket 41.

Means 61 are provided for tiltably displacing the stern bracket 33 relative to the transom bracket means 21 so as to displace the propulsion unit 13 between the running position and the raised position. Various arrangements can be employed. However, it is desirable to employ an arrangement which includes an extensible member of relatively short length and which is adapted to readily prevent upward tilting of the propulsion unit 13 when operating in reverse. In the disclosed construction, such means 61 comprises a linkage 65 including a pivot link 71 which is pivotally connected, by any suitable means, to the transom bracket means 21 about a fixed axis 73 which is parallel to and located below the upper tilt axis 27.

In addition, the means 61 for tiltably displacing the stern bracket 33 (and therefore the propulsion unit 13) also includes an extensible link 75 which, at one end, is pivotally connected, by any suitable means, to the pivot link 71 about an axis 77 parallel to the upper tilt axis 27 and which, at its other end, is pivotally connected, by any suitable means, to the stern bracket 33 about an axis 79 parallel to the upper tilt axis 27.

In a preferred embodiment, the extensible link 75 is a hydraulic cylinder-piston assembly 99 having an extended length less than that required to lift the stern bracket 33 to the fully raised position. The hydraulic cylinder piston assembly 99 can include internal means (not shown) for permitting upward propulsion unit tilting and absorbtion of energy in the event of the striking of an underwater obstacle and for permitting return movement of the propulsion unit 13 to the normal running position.

Any suitable means can be employed to provide hydraulic fluid to the hydraulic cylinder-piston assembly 99 for extension and retraction thereof.

One particularly advantagous arrangement for regulating the application of pressure fluid to the hydraulic cylinder-piston assembly 99 is described in co-pending application Ser. No. 183,209, filed Sept. 2, 1980.

The axes 73 and 77 are located such that, when the stern bracket 33 is in the running position, a straight line 81 connecting the axes 73 and 77 is generally vertical and extends in closely adjacent relation to the upper tilt axis 27 connecting the transom bracket means 21 and the stern bracket 33. In addition, a line 85 extending through the axes 77 and 79 at the ends of the extensible link 75 has a moment arm 87 with respect to the upper or tilt pivot axis 27 and forms an acute angle 89 with the line 81.

In order to obtain upward pivotal or trimming movement of the swivel bracket 41 relative to the stern bracket 33 prior to upward pivotal or tilting movement of the stern bracket 33 relative to the transom bracket means 21, it is preferred that, the moment arm 87 between the upper pivot or tilt axis 27 and the line 85 extending between the axes 77 and 79 is several times less than the moment arm 91 from the upper pivot or tilt axis 27 to the axis 93 of the propeller 15. In addition, it is preferred that the ratio of the moment arms from the upper pivot or tilt axis 27 to the line 85 and to the propeller axis 93 be less than the ratio of the moment arms from trim axis 49 to the axis of the extensible member 53 and to the axis 93 of the propeller 15.

Accordingly, assuming that equal force is applied along the line 55 and along the axis of the extensible member 53, trimming will occur prior to tilting. If desired, the force applied along the line 85 and the axis of the extensible member 53 can be unequal, i.e., can be greater along the axis of the extensible member 53, in order to obtain trimming prior to tilting when the previously mentioned ratio of the moment arms relative to the upper pivot or tilt axis 27 is equal to or greater than the previously mentioned ratio of the moment arms relative to the lower pivot or trim axis 49. Greater force can be obtained by increasing the cross sectional dimensions of the cylinder of the trim cylinder piston assembly 53 as compared to the cylinder of the tilt cylinder-piston assembly 99 and/or by applying higher fluid pressure to the trim cylinder-piston assembly 53 as compared to the tilt cylinder-piston assembly 99.

The means 61 for tiltably displacing the stern bracket 33 further includes means 101 operable, in response to extension of the extensible link 75, for pivoting the pivot link 71 so as to reduce or eliminate the acute angle 89 and thereby to additionally increase the distance from the axis 73 to the axis 79 beyond the increase accomplished by extension of the link 75. While various arrangements can be employed, in the illustrated construction, such means 101 comprises a follower link 103, which, at one end, is pivotally connected by any suitable means, to the pivot link 71 about an axis 105 parallel to the upper tilt axis 27 and which, at its other end, is pivotally connected, by any suitable means, to the stern bracket 33 about an axis 107 parallel to the upper tilt axis 27. The axes 105 and 107 are located such that, when the stern bracket 33 is in the normal running position, a straight line 109 extending therebetween is generally parallel and rearwardly of the line 81 extending between the axes 73 and 77.

In operation, extension of the hydraulic cylinder-piston assembly 99 serves to tilt the stern bracket 33 upwardly, thereby also causing upward and rearward movement, in an arc about the tilt axis 27, of the axis 107 of the pivotal connection between the stern bracket 33 and the follower link 103. Such movement serves to cause the axis 105 of the pivotal connection between the follower link 103 and the pivot link 71 to move upwardly in an arc about the fixed axis 73 of the pivot link 71. Such movement of the pivot link 71 reduces the angle 89 toward zero, and additionally increases the distance between the fixed pivot link axis 73 and the axis 79 connecting the extensible link 75 to the stern bracket 33 beyond the increase brought about directly by increase in the distance between the ends of the hydraulic cylinder piston assembly 99. As a consequence of the movement of the pivot link 71, an extensible member of lesser length can be employed and still accomodate a full swing of the stern bracket 33 between the normal running position and the raised position. As is also clearly apparent from the drawings, the extensible link 75 has a moment arm 87 from the axis 85 thereof to the tilt axis 27, which moment arm 87 increases as the stern bracket 33 travels from the running position to the raised position.

Figure 4:
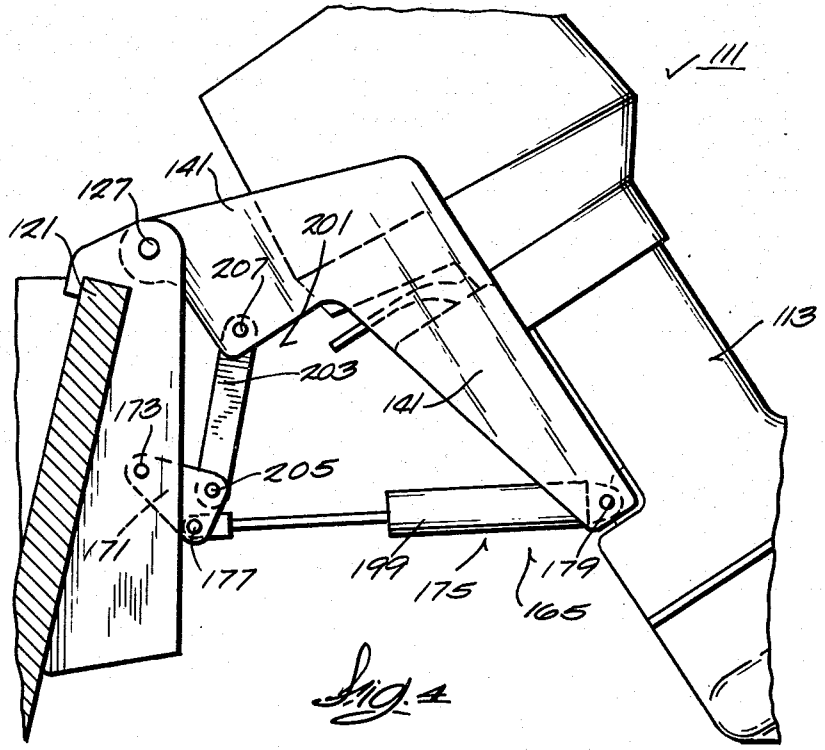
FIG. 4 is a fragmentary view similar to FIG. 3 illustrating the outboard motor in a partially raised or tilt position.
Figure 3:
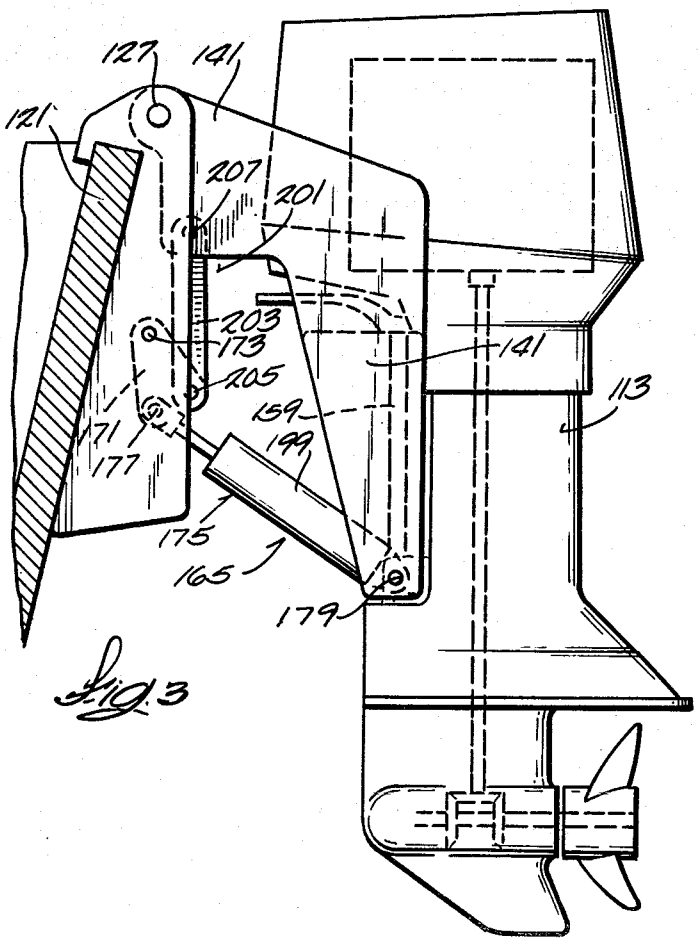
FIG. 3 is a fragmentary side elevational view of another embodiment of an outboard motor which embodies various of the features of the invention, and which is shown in the normal running position.

Shown in FIGS. 3 and 4, is still another embodiment of a marine propulsion device in the form of an outboard motor 111 which embodies a linkage 165 similar to the linkage 65 described with respect to the outboard motor 11. Except for the linkage 165 or displacing the propulsion unit 113 between the normal running position shown in FIG. 3 and the fully raised position, the outboard motor 111 is of conventional construction, including transom bracket means in the form of a transom bracket 121, and means for mounting the propulsion unit 113 from the transom bracket 121 for steering movement in a horizontal plane and for tilting movement in a vertical plane between the running and fully raised positions. Such means comprises a swivel bracket 141 which is pivotally connected to the transom bracket 121 for tilting movement about a horizontal upper axis 127, together with a king pin 159 which is fixedly connected to the propulsion unit 113 and which extends pivotally in the swivel bracket 141 to afford steering of the propulsion unit 113 relative to the swivel bracket 141 and transom bracket 121.

As in the construction shown in FIGS. 1 and 2, the linkage 165 is provided for tilting the intermediate or second bracket in the form of the swivel bracket 141 between a normal running position in which the propeller is submerged in water and a raised position in which the propeller is accessable above the water.

This linkage 165 comprises, as in the embodiment shown in FIG. 1, a pivot link 171 which is pivotally connected by any suitable means, to the transom bracket 121 about a fixed axis 173 located at a point below the upper axis 27, together with an extendable link 175 which, at one end, is pivotally connected by any suitable means, to the pivot link 171 about an axis 177 parallel to the upper axis 127 and which, at its other end, is pivotally connected, by any suitable means, to the swivel bracket 141 about another axis 179 parallel to the upper axis 127. In the illustrated construction, the extendable link 175 comprises a hydraulic cylinder-piston assembly 199. Any suitable means can be employed for hydraulically causing extension and retraction of the hydraulic cylinder-piston assembly 199.

The linkage 165 also includes means 201 operable, in response to extension of the extensible link 175, for pivotally displacing the pivot link 171 so as to increase the distance between the fixed axis 173 of the pivot link 171 and the axis 179 of the connection between the extendable link 175 and the swivel bracket 141. As in the construction shown in FIGS. 1 and 2, such means 201 comprises a follower link 203 which, at one end, is pivotally connected by any suitable means, to the pivot link 171 about an axis 205 which is parallel to the upper axis 127 and which, at its other end, is pivotally connected, by any suitable means, to the swivel bracket 141 about an axis 207 which is parallel to the upper axis 27. The location or arrangement of the axes 127, 173, 177, 179, 205 and 207 is essentially identical to the arrangement described with respect to the embodiment disclosed in FIGS. 1 and 2, except that the axes 127, 179 and 207 represent connections to the swivel bracket 141 as distinguished from the stern bracket 33 of the embodiment shown in FIGS. 1 and 2. With the same exception, the operation of the linkage 165 shown in FIGS. 3 and 4 is identical to the operation of the linkage shown in FIGS. 1 and 2.

Various of the features of the invention are set forth in the following claims.

We claim:

1. An outboard motor comprising a transom bracket means adapted to be fixedly mounted to a boat transom, second bracket means, means connecting said second bracket means to said transom bracket means for pivotal movement of said second bracket means in a vertical plane about a first axis which is horizontal when said transom bracket means is boat mounted, a pivot link, means pivotally connecting said pivot link to said transom bracket means for pivotal movement about a second axis parallel to said first axis, an extensible link having opposite ends, means pivotally connecting one of said opposite ends of said extensible link to said pivot link about a third axis parallel to said first axis, means pivotally connecting the other of said opposite ends of said extensible link to said second bracket means about a fourth axis parallel to said first axis, means including a member connected to said pivot link and operable, in response to extension of said extensible link, for pivoting said pivot link so as to additionally increase the distance from said second axis to said fourth axis, a propulsion unit including a propeller, and means connecting said propulsion unit to said second bracket means for pivotal steering movement of said propulsion unit in a horizontal plane relative to said second bracket means and independently of said member.

2. An outboard motor, comprising a transom bracket means adapted to be fixedly mounted to a boat transom, second bracket means, means connecting said second bracket means to said transom bracket means for pivotal movement of said second bracket means in a vertical plane about a first axis which is horizontal when said transom bracket means is boat mounted, a pivot link, means pivotally connecting said pivot link to said transom bracket for pivotal movement about a second axis parallel to said first axis, an extensible link having opposite ends, means pivotally connecting one of said opposite ends of said extensible link to said pivot link about a third axis parallel to said first axis, means pivotally connecting the other of said opposite ends of said extensible link to said second bracket means about a fourth axis parallel to said first axis, and means operable, in response to extension of said extensible link, for pivoting said pivot link so as to additionally increase the distance from said second axis to said fourth axis, said means for additionally increasing the distance from said second axis to said fourth axis in response to extension of said extensible link comprising a follower link having opposed ends, means pivotally connecting one of said opposed ends of said follower link to said pivot link about a fifth axis parallel to said first axis, means pivotally connecting the other of said opposed ends of said follower link to said second bracket means about a sixth axis parallel to said first axis, a propulsion unit including a propeller, and means connecting said propulsion unit to said second bracket means for pivotal steering movement of said propulsion unit in a horizontal plane relative to said second bracket means independently of said follower link.

3. An outboard motor in accordance in claim 2 wherein said pivot and follower links are rigid links.

4. An outboard motor in accordance with claim 1 wherein said second bracket means comprises a swivel bracket connected to said transom bracket means about said first axis and wherein said means connecting said propulsion unit to said second bracket means comprises means including a king pin for pivotally connecting said propulsion unit to said swivel bracket for steering movement of said propulsion unit relative to said swivel bracket in a horizontal plane about a vertical axis.

5. An outboard motor in accordance with claim 1 wherein said second bracket means comprises a stern bracket connected to said transom bracket means about said first axis and wherein said means connecting said propulsion unit to said second bracket means includes a swivel bracket connected to said stern bracket for vertical tilting movement about a seventh axis parallel to said first axis, means for adjustably pivotally displacing said swivel bracket relative to said stern bracket about said seventh axis, and means including a king pin for pivotally connecting said propulsion unit to said swivel bracket for steering movement of said propulsion unit relative to said swivel bracket in a horizontal plane about a vertical axis.

6. An outboard motor in accordance with claim 2 wherein said second, third and fifth axes form a triangular pattern in a vertical plane.

7. An outboard motor comprising propulsion unit including a propeller, a transom bracket means adapted to be fixedly mounted to a boat transom, second bracket means, means connecting said propulsion unit to said second bracket means for pivotal steering movement of said propulsion in a horizontal plane relative to said second bracket means, means connecting said second bracket means to said transom bracket means for pivotal movement of said second bracket means in a vertical plane about a first axis which is horizontal when said transom bracket means is boat mounted and between a normal running position in which said propeller is submerged in water and a raised position in which said propeller is accessible above the water, a pivot link, means pivotally connecting said pivot link to said transom bracket means for pivotal movement about a second axis parallel to said first axis, an extensible link having opposite ends and being disposed principally vertically when said second bracket means is in the running position and disposed principally horizontally when said second bracket means is in the raised position, means pivotally connecting one of said opposite ends of said extensible link to said pivot link about a third axis parallel to said first axis, means pivotally connecting the other of said opposite ends of said extensible link to said second bracket means about a fourth axis parallel to said first axis, and means operable, in response to extension of said extensible link, for pivoting said pivot link so as to additionally increase the distance from said second axis to said fourth axis.

8. An outboard motor in accordance with claim 7 wherein said extensible link expands during movement of said second bracket means from the running position to the raised position and wherein said pivot link and said second bracket means pivot in the same rotational direction during pivotal movement of said second bracket means.

9. An outboard motor in accordance with claim 7 wherein said extensible link has an axis and a moment arm from said extensible link axis to said first axis which moment arm increases as said second bracket means travels from the running position to the raised position.

10. An outboard motor in accordance with claim 1 wherein said extensible link comprises a hydraulic cylinder-piston assembly.

11. An outboard motor in accordance with claim 1 wherein said second bracket means is pivotable about the first axis between a running position and a position raised relative to the running position, and wherein the distance between said second and said fourth axes is greater when said second bracket means is in the raised position than when said second bracket means is in the running position.

12. An outboard motor in accordance with claim 2 wherein upward tilting movement of said propulsion unit relative to said transom bracket means in response to extension of said extensible link serves to cause said follower link to rotate said pivot link in the direction to increase the distance between said second and fourth axes.

13. An outboard motor comprising a transom bracket means adapted to be fixedly mounted to a boat transom, second bracket means, means connecting said second bracket means to said transom bracket means for pivotal movement of said second bracket means in a vertical plane about a first axis which is horizontal when said transom bracket means is boat mounted, a propulsion unit including a propeller, means connecting said propulsion unit to said second bracket means for pivotal steering movement of said propulsion unit in a horizontal plane relative to said second bracket means, a pivot link, means pivotally connecting said pivot link to said transom bracket means for pivotal movement about a second axis parallel to said first axis, an extensible link having opposite ends, means pivotally connecting one of said opposite ends of said extensible link to said pivot link about a third axis parallel to said first axis, means pivotally connecting the other of said opposite ends of said extensible link to said second bracket means about a fourth axis parallel to said first axis, and means operable, in response to extension of said extensible link, for pivoting said pivot link so as to additionally increase the distance from said second axis to said fourth axis, said pivot link pivoting means including a follower link pivotally connected between said second bracket means and said pivot link and movable angularly relative to said transom bracket means in response to pivotal movement of said second bracket means relative to said transom bracket means.

14. An outboard motor comprising a transom bracket means adapted to be fixedly mounted to a boat transom, second bracket means, means connecting said second bracket means to said transom bracket means for pivotal movement of said second bracket means in a vertical plane about a first axis which is horizontal when said transom bracket means is boat mounted, a propulsion unit including a propeller, means connecting said propulsion unit to said second bracket means for pivotal steering movement of said propulsion unit in a horizontal plane relative to said second bracket means, a pivot link, means pivotally connecting said pivot link to said transom bracket means for pivotal movement about a second axis parallel to said first axis, an extensible link having opposite ends, means pivotally connecting one of said opposite ends of said extensible link to said pivot link about a third axis parallel to said first axis, means pivotally connecting the other of said opposite ends of said extensible link to said second bracket means about a fourth axis parallel to said first axis, and means operable, in response to extension of said extensible link, for pivoting said pivot link so as to additionally increase the distance from said second axis to said fourth axis, said means for additionally increasing the distance from said second axis to said fourth axis in response to extension of said extensible link comprising a follower link having opposed ends, means pivotally connecting one of said opposed ends of said follower link to said pivot link about a fifth axis parallel to said first axis, and means pivotally connecting the other of said opposed ends of said follower link to said second bracket means about a sixth axis which is parallel to said first axis, and which is located between said first and fourth axis.

* * * * *

UNITED STATES PATENT AND TRADEMARK OFFICE

CERTIFICATE OF CORRECTION

PATENT NO. : 4,354,848

DATED : October 19, 1982

INVENTOR(S) : Charles B. Hall, et al.

It is certified that error appears in the above–identified patent and that said Letters Patent are hereby corrected as shown below:

In the abstract, line 9, "sterring" should be -- steering --.

Claim 7, column 8, line 51, before "propulsion", insert -- a --.

Signed and Sealed this

*Eighteenth* Day of *June 1985*

[SEAL]

*Attest:*

DONALD J. QUIGG

*Attesting Officer*

*Acting Commissioner of Patents and Trademarks*